US005168659A

United States Patent [19]

Schneider

[11] Patent Number: 5,168,659

[45] Date of Patent: Dec. 8, 1992

[54] APPARATUS FOR FINELY WORKING PISTON RINGS

[75] Inventor: Eberhard Schneider, Solingen, Fed. Rep. of Germany

[73] Assignee: Goetze AG, Burscheid, Fed. Rep. of Germany

[21] Appl. No.: 676,278

[22] Filed: Mar. 28, 1991

[30] Foreign Application Priority Data

Apr. 11, 1990 [DE] Fed. Rep. of Germany ..... 4011715

[51] Int. Cl.[5] ..... B24B 19/11; B24B 19/10

[52] U.S. Cl. ..... 51/161; 51/157; 51/289 R

[58] Field of Search ..... 51/151, 154, 157, 161, 51/216 A, 216 T, 217 A, 217 T, 218 A, 218 T, 236, 237 R, 237 M, 237 CS, 237 T, 289 R, 290

[56] References Cited

U.S. PATENT DOCUMENTS

| | | | |
|---|---|---|---|
| 2,318,837 | 5/1943 | Connor | 51/290 |
| 2,344,924 | 3/1944 | Ryder | 51/157 |
| 2,654,977 | 10/1953 | Squibb et al. | 51/236 |
| 2,749,672 | 6/1956 | Haldeman | 51/236 |
| 2,763,106 | 9/1956 | Evashevski | 51/289 R |
| 3,296,747 | 1/1967 | Philippsen et al. | 51/161 |
| 3,762,107 | 10/1973 | Sullivan | 51/290 |
| 4,209,951 | 7/1980 | Gillette | 51/67 X |

FOREIGN PATENT DOCUMENTS

| | | | |
|---|---|---|---|
| 1216730 | 5/1966 | Fed. Rep. of Germany . | |
| 1250759 | 9/1967 | Fed. Rep. of Germany . | |
| 0751584 | 7/1980 | U.S.S.R. | 51/290 |
| 1268383 | 11/1986 | U.S.S.R. | 51/157 |

*Primary Examiner*—Bruce M. Kisliuk
*Assistant Examiner*—John A. Marlott
*Attorney, Agent, or Firm*—Spencer, Frank & Schneider

[57] ABSTRACT

A device is provided for finely working exterior circumferential faces of self-tensioning piston rings which are combined into a packet. The device includes a cylindrical sleeve having an interior wall surface against which the circumferential faces of the rings lie under their own tension. Two discs are disposed between which the rings are arranged in the sleeve with a slight axial spacing. The packet of rings is rotatable relative to the sleeve and movable back and forth within the sleeve, with at least one of the discs being pivotal about the longitudinal axis of the sleeve. A mechanism is provided for pivoting the one disc about a pivot angle that is variable and arrestable for subjecting the rings to a tilting movement with the sleeve.

6 Claims, 1 Drawing Sheet

APPARATUS FOR FINELY WORKING PISTON RINGS

CROSS REFERENCE TO RELATED APPLICATIONS

The present application claims the rights of priority with respect to application Ser. No. P 40 11 715.4 filed Apr. 11, 1990 in the Federal Republic of Germany, the subject matter of which is incorporated herein by reference.

BACKGROUND OF THE INVENTION

The present invention relates to an apparatus for finely working the outer circumferential faces of self-tensioning piston rings that are combined into a packet, with the rings lying under their inherent tension against the inner wall of a cylindrical sleeve and being arranged with slight axial spacing between two discs, and wherein the rings are rotated relative to the sleeve and moved back and forth, with at least one disc being pivotal.

In order to produce very smooth and geometrically accurate surfaces, piston rings are finely worked with special equipment. If the fine working is effected by lapping, the piston ring surface to be worked slides on a corresponding counterface of a lapping tool. A fluid containing a lapping agent is introduced between the two parts to produce a polishing or grinding effect.

German Pat. No. 1,216,730 discloses an apparatus in which piston rings, which are held together between two discs, are finely worked in a so-called lapping sleeve. The discs can be driven to rotate relative to the sleeve but cannot be tilted. During the lapping process, the individual rings are caused to rotate so that they are uniformly worked over their entire circumference. This process phase initially produces a smooth, cylindrically round lapped running face. However, piston rings often should have a convexly rounded running surface in their finished state, that is, the cross-sectional outline of the running face has an arcuate curve. In order to meet this requirement, the initially cylindrically round lapping running faces are lapped into the convex shape in an additional process step. Various methods can be employed to produce the convex running surface. One possibility is, for example, to cause the rings to perform a tilting movement within the sleeve.

For this purpose, German Pat. No. 1,250,759 discloses a clamping disc which is made tiltable in the rhythm of its rotary drive. The tilting movement of the clamping disc is generated by a sloped end face on a hollow shaft which surrounds the spindle of the clamping disc and against which the clamping disc spindle is supported at a frontal face that extends perpendicularly to the spindle axis. The magnitude of the tilting movement is here a function of the angle of the sloped face; that is, for every variation in convexity required for each series, a special hollow shaft must be employed. This involves high tool costs and incurs high retrofitting expenditures.

SUMMARY OF THE INVENTION

It is an object of the present invention to improve an apparatus of this type so that various contours with respect to convexity can be produced without interrupting the working process and to simultaneously reduce manufacturing costs.

The above and other objects are accomplished according to the invention by the provision of a device for finely working exterior circumferential faces of self-tensioning piston rings which are combined into a packet, including: a cylindrical sleeve having an interior wall surface against which the circumferential faces of the rings in the packet lie under their own tension; two discs between which the rings are loosely arranged one on top of another in the sleeve, the packet of rings being rotatable relative to the sleeve and movable back and forth within the sleeve, with at least one of the discs being pivotal about the longitudinal axis of the sleeve; and means for pivoting the one disc about a pivot angle that is variable and arrestable for subjecting the rings to a tilting movement within the sleeve.

Thus, according to the invention the pivot angle of at least one of the discs is made variable and arrestable. With this measure it is possible with only one tool, namely a disc carrier, to set any desired pivot angle so that it is possible to change a set pivot angle during the manufacturing process. If, for example, due to wear in the sleeve, a change in the convexity of the individual rings becomes evident, it is possible, without changing tools, to merely adjust the pivot angle of the disc carrier. Moreover, the device can be employed for cylindrical round lapping as well as for convex lapping.

For cylindrical round lapping, the disc carrier and the disc, respectively, are set to be parallel that is, without any angular deflection relative to the packet of piston rings. This process can be effected without interrupting the lapping process by way of a machine control computer. Preferably, the disc carrier includes an axially extending rod. The rod passes through a tubular body which is connected with a displaceable frame. The tubular body serves to accommodate the disc body so that, according to a further aspect of the invention, it is possible to pivotally mount the rod in the open end region of the tubular body. The arrangement of the pivot (bearing) point in the region of the disc permits relatively large pivot angles so that a relatively large spectrum of use results with respect to the piston ring diameter and the desired degree of convexity.

In another aspect of the invention, in order to realize a defined pivot angle, an adjustment mechanism is disposed in the end region of the rod facing away from the disc body. Preferably this adjustment mechanism is composed of a motor driven threaded drive that is connected with the axially displaceable frame. In this way it is possible to change the pivot angle incrementally or continuously by way of, for example, a guide station computer during the back and forth movement of the rings, that is, during the lapping process, and to arrest the pivot angle to thus combine two process steps (for example, cylindrical lapping and convex lapping) for one set of clamped-in rings. The relative movement required between the piston rings and the sleeve is effected, according to a further aspect of the invention, in that the cylindrical sleeve is rotationally drivable.

The invention will now be described in detail in connection with the accompanying drawings which illustrate one embodiment of the invention.

DETAILED DESCRIPTION OF PREFERRED EMBODIMENT

Figure 1:
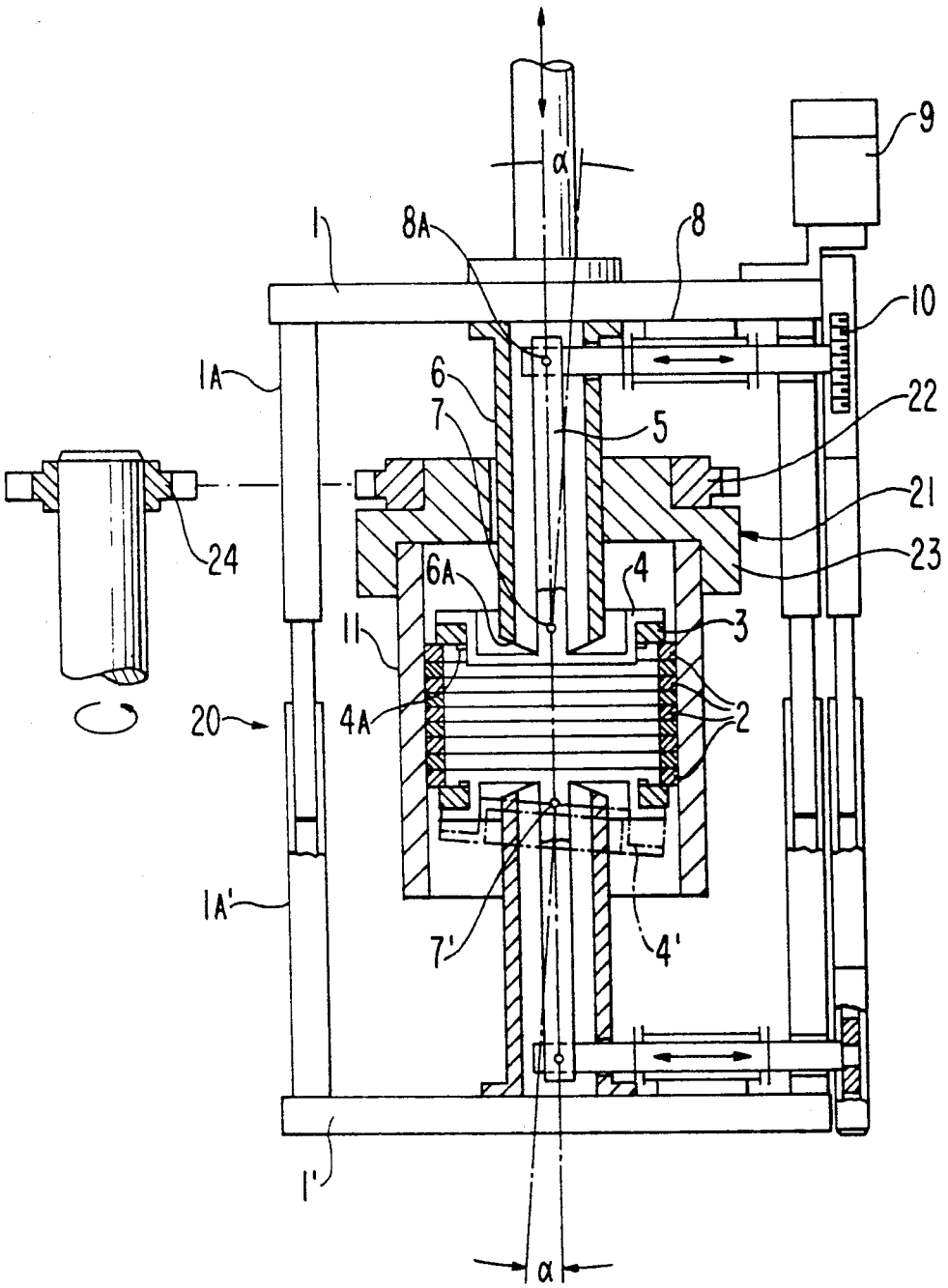
FIG. 1 shows a side elevational view in partial cross section of one embodiment of the invention.

FIG. 1 shows a device for finely working a packet of piston rings which includes an axially displaceable, two-part frame 1, 1'. Frame parts 1 and 1' have cooperating legs 1*a* and 1*a* which are constructed to produce a telescoping arrangement 20 driven by a device (not shown) for effecting the axial displacement of the frame parts. Otherwise, both frames parts 1, 1' are almost identical in their structural configuration so that in the description below only the assemblies connected with frame part 1 will be discussed.

A packet of piston rings composed of self-tensioning piston rings 2 lie loosely on top of one another within a cylindrical sleeve 11. The packet of rings is limited at its upper end region by a disc 3. A similar disc is disposed in the lower end region of the packet. Disc 3 is releasably connected with a disc carrier 4, for example by means of a spring ring 4*a*. Disc carrier 4 includes an axially extending rod 5 which is surrounded by a tubular body 6 fixed at its upper end to frame 1. Rod 5 is pivotally mounted to tubular body 6 at a bearing location 7 near the open end region of the tubular body 6 adjacent the top ring in the ring packet. Tubular body 6 has a sloped open end face 6*a* so that disc carrier 4 can be pivoted about bearing location 7. A similar disc carrier 4' and bearing location 7' is provided in the lower end region of the packet of rings 2. In the upper end region of rod 5, there is provided a threaded drive 8 having an articulated connection 8*a* with rod 5 of disc carrier 4. Threaded drive 8 is driven by a motor 9 by way of a worm gear 10.

During operation of the device, frame parts 1, 1' perform an axial back and forth movement. This additional movement has a rotary motion superposed on it in that the sleeve 11 is caused to rotate by means of a drive 21 consisting of a chain wheel 22 which is attached to a chuck 23 at the end of sleeve 11 and a second chain wheel 24 rotating by a motor (not shown).

According to the invention, a pivoting movement with any desired pivot angle ($\alpha$, $\alpha'$) can be performed by way of the motor 9 and disc carrier 4 which is guided by threaded drive 8. In this way it is possible to lap the rings or, more precisely, the packet of rings 2 circularly or convexly in one clamping without requiring additional tools. Moreover, cost intensive equipment changes and machine down times (for example to install the tools for otherwise separately performed process steps) are no longer necessary.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A device for finely working exterior circumferential faces of self-tensioning piston rings which are combined into a packet, comprising:

a cylindrical sleeve having an interior wall surface against which the circumferential faces of the rings lie under their own tension;

two discs between which the rings are arranged in said sleeve with a slight axial spacing, the packet of rings being rotatable relative to said sleeve and movable back and forth within said sleeve, with at least one of said discs being pivotal about the longitudinal axis of the sleeve;

disc carrier means releasably connected with said one disc for pivoting said one disc about a pivot angle that is variable and arrestable for subjecting said rings to a tilting movement within said sleeve, said disc carrier means including an axially extending rod projecting in a direction away from said one disc;

an axially displaceable frame enclosing said sleeve; and a tubular body connected with said frame, said rod extending through said tubular body.

2. A device as defined in claim 1, wherein said tubular body has an open end region adjacent said one disc and said pivoting means includes means for pivotally mounting said rod near the open end region of said tubular body.

3. A device as defined in claim 2, wherein said pivoting means further comprises adjustment means connected with said rod at an end region of said rod facing away from said one disc for setting a defined pivot angle of said disc carrier means.

4. A device as defined in claim 3, wherein said adjustment means comprises a motor driven threaded drive.

5. A device as defined in claim 4, wherein said threaded drive is connected with said frame.

6. A device as defined in claim 1, and further comprising means for rotatably driving said sleeve.

* * * * *